US007331657B2

(12) United States Patent
Shrivastava et al.

(10) Patent No.: US 7,331,657 B2
(45) Date of Patent: Feb. 19, 2008

(54) HIGH VOLTAGE ARM ASSEMBLY WITH INTEGRATED RESISTOR, AUTOMATIC HIGH VOLTAGE DEFLECTION ELECTRODE LOCATOR, AND SPECIAL INSULATION

(75) Inventors: Dilip Shrivastava, Bensenville, IL (US); Mick Rybicki, Downers Grove, IL (US)

(73) Assignee: Videojet Technologies, Inc., Wood Dale, IL (US)

( * ) Notice: Subject to any disclaimer, the term of this patent is extended or adjusted under 35 U.S.C. 154(b) by 248 days.

(21) Appl. No.: 11/150,934

(22) Filed: Jun. 13, 2005

(65) Prior Publication Data

US 2005/0280677 A1 Dec. 22, 2005

Related U.S. Application Data

(60) Provisional application No. 60/581,045, filed on Jun. 17, 2004.

(51) Int. Cl.
*B44J 2/09* (2006.01)

(52) U.S. Cl. ..... 347/77

(58) Field of Classification Search ..... 347/76, 347/77, 73, 82

See application file for complete search history.

(56) References Cited

U.S. PATENT DOCUMENTS 4,201,993 A * 5/1980 Ito et al. ..... 347/77
6,848,774 B2 2/2005 Shrivastava ..... 347/77
2003/0184620 A1 10/2003 Shrivastava et al.

FOREIGN PATENT DOCUMENTS

JP 2004 130573 A 4/2004
WO WO 98/28146 A 7/1998

* cited by examiner

*Primary Examiner*—K. Feggins
(74) *Attorney, Agent, or Firm*—McAndrews, Held & Malloy, Ltd.

(57) ABSTRACT

According to an embodiment of the present invention, a deflection electrode assembly is provided for use in a continuous ink jet printer of the type which projects a stream of ink drops toward a substrate and controls placement of the ink drops on the substrate by selectively charging the individual ink drops and passing the charged ink drops through a deflection field created by the deflection electrode assembly. The deflection electrode assembly includes a high voltage electrode, a low voltage electrode, and an insulating housing which positions the high and low voltage electrodes in a predetermined spaced relationship along the ink drop stream. The insulating housing also has an internal resistor in electrical connection to the high voltage electrode and an external circuit. The insulating housing also contains an insulating member which supports the high voltage electrode as well as minimizes the possibility for arcing between the two electrodes.

19 Claims, 8 Drawing Sheets

HIGH VOLTAGE ARM ASSEMBLY WITH INTEGRATED RESISTOR, AUTOMATIC HIGH VOLTAGE DEFLECTION ELECTRODE LOCATOR, AND SPECIAL INSULATION

RELATED APPLICATIONS

This application claims priority of provisional application Ser. No. 60/581,045 filed on Jun. 17 2004.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to ink jet printing, and in particular to an improved deflection electrode assembly for a continuous ink jet printer.

Continuous ink jet printers are well known in the field of industrial coding and marking, and are widely used for printing information, such as expiry dates, on various types of substrate passing the printer on production lines. As shown in FIG. 1, a jet of ink is broken up into a regular stream of uniform ink drops by an oscillating piezoelectric element. The drops then pass a charging electrode where the individual drops are charged to selected voltages. The drops then pass through a transverse electric field (deflection field) provided across a pair of deflection electrodes. Each drop is deflected by an amount that depends on its respective charge. If a drop is uncharged, it will pass through the deflection electrodes without deflection. Uncharged and slightly charged drops are collected in a catcher and returned to the ink supply for reuse. A drop following a trajectory that misses the catcher will impinge on the substrate at a point determined by the charge on the drop. Often, each charged drop is interspersed by a guard drop with substantially no charge to decrease electrostatic and aerodynamic interaction between charged drops. As the substrate moves past the printer, the placement of the drop on the substrate in the direction of motion of the substrate will have a component determined by the time at which the drop is released. The direction of motion of the substrate will hereinafter be referred to as the horizontal direction, and the direction perpendicular to this, in the plane of the substrate will hereinafter be referred to as the vertical direction. These directions are unrelated to the orientation of the substrate and printer in space. If the drops are deflected vertically, the placement of a drop in the vertical and horizontal direction is determined both by the charge on the drop and the position of the substrate.

As shown in FIG. 1, the print head of a continuous ink jet printer is often composed of a number of individual parts. For instance, the print head often contains a support frame, a low voltage electrode, a high voltage electrode, a resistor, an oscillating piezoelectric element, insulation, and a catcher. The high voltage electrode and low voltage electrode are generally separate and distinct pieces. The low voltage electrode is generally mounted to a support frame (not shown) for grounding. The high voltage electrode is typically connected in series with a resistor. Generally, the resistor limits discharge energy between the high voltage and low voltage electrodes under fault conditions.

One lead of the resistor is typically electrically connected to the high voltage electrode, and the other lead of the resistor is typically electrically connected to an external power circuit. The resistor is typically located within the print head, as shown in FIG. 1. As such, the environment of the resistor is typically filled with corrosive inks and cleaning solutions which may attack and compromise the functionality of the resistor. In order to protect the resistor from its harsh environment, the resistor is typically wrapped in sealing materials, which extend several inches from the ends of the resistor. The wrapping results in a stiff cable which is difficult to route and place among various tubes and lines during assembly and maintenance of the print head. Further, over time, the corrosive liquids can penetrate the wrappings, causing the resistor to fail. Accordingly, it is desirable to locate and shield the resistor from corrosive elements without wrapping the resistor in sealing materials during installation.

Also shown in FIG. 1, are the high voltage electrode and the low voltage electrode. The strength of the defection field, and thus proper operation of the ink jet, is a function of the spacing between the high voltage electrode and the low voltage electrode. If the gap between the electrodes is not optimized, the strength of the deflection field may be compromised, resulting in poor print quality and/or generating printer faults due to drops being deflected in undesirable locations.

The high voltage electrode and low voltage electrode are typically mounted separately to support structure within the printhead. Such mounting configuration typically requires a manual configuration of the gap between the high voltage electrode and the low voltage electrode. Manual configuration of the gap between the electrodes is prone to human error, thus exposing the printer to sub-optimal performance. Accordingly, it is desirable to have an assembly in which the spacing between the electrodes is predetermined, automatic, and optimized.

FIG. 1 also illustrates a dielectric insulator that may be used to prevent arching from the edges of a high voltage electrode to the ground electrode. Arcing is more probable at the edges of the high voltage electrode and where its distance to the ground electrode is minimal. This phenomenon has been reported in U.S. Pat. No. 6,848,774 for "Ink Jet Printer Deflection Electrode Assembly having a Dielectric Insulator." Typically, the insulation is a loose piece, which is vulnerable to coming off during cleaning, or other operations. If the insulation does come off, the high voltage electrode may arc to the low voltage electrode, and the ink jet will operate improperly. Accordingly, it is desirable to have a special insulation which is robust during operation and maintenance.

Therefore, a need exists for a system and method for facilitating easier installation and improving robustness of a continuous ink jet printer. Such a system and method may protect a resistor from a corrosive environment without being wrapped. Moreover, such a system and method may easily optimize the space between the high voltage electrode and low voltage electrode. Furthermore, such a system and method may incorporate insulation so it is not easily detached.

BRIEF SUMMARY OF THE INVENTION

According to certain aspects of an embodiment of the present invention, a deflection electrode assembly is provided for use in a continuous ink jet printer of the type which projects a stream of ink drops toward a substrate and controls placement of the ink drops on the substrate by selectively charging the individual ink drops and passing the charged ink drops through an electric field created by the deflection electrode assembly. The deflection electrode assembly includes a high voltage electrode, a low voltage electrode, and an insulating housing for positioning the high and low voltage electrodes in a predetermined spaced relationship along the ink drop stream. The insulating housing has an opening for supporting the high voltage electrode at a predetermined distance from the low voltage electrode. Moreover, a portion of the insulating housing is partially between the high voltage electrode and the low voltage electrode. The portion of the insulating housing between the high voltage electrode and the low voltage electrode minimizes arcing by exposing the high voltage electrode along the path of the ink drop stream. The deflection electrode assembly further comprises a resistor which is hermetically sealed within the insulating housing. The resistor is connected in series between an external, high voltage power source and the high voltage electrode. Placing the resistor inside the insulating housing minimizes the resistor's exposure to corrosive elements and simplifies installation.

Figure 1:
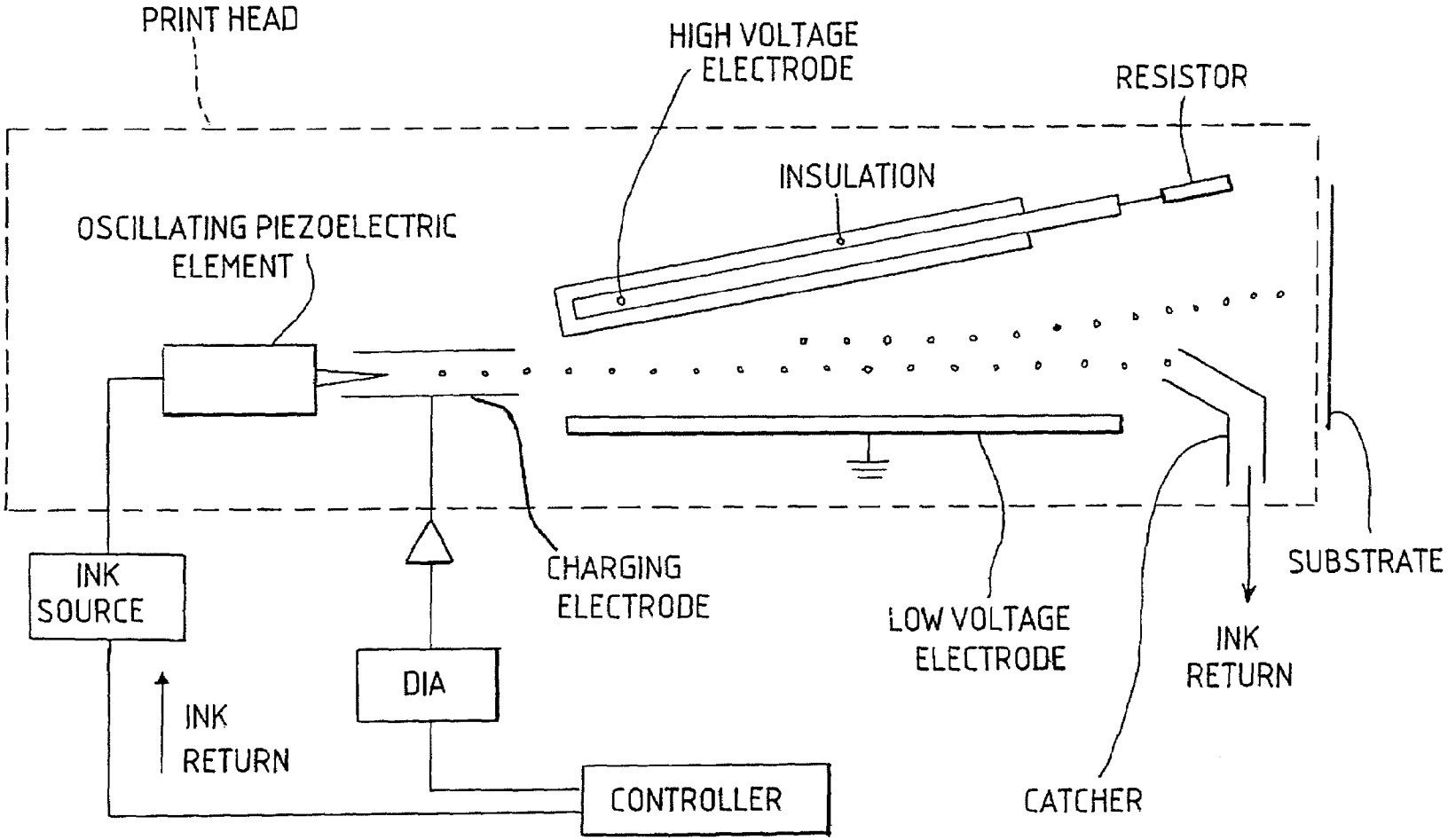
FIG. 1 shows the operation of a typical continuous ink jet printer and print head.

The foregoing summary, as well as the following detailed description of the preferred embodiments of the present invention, will be better understood when read in conjunction with the appended drawings. For the purpose of illustrating the preferred embodiments of the present invention, the drawings depict embodiments that are presently preferred. It should be understood, however, that the present invention is not limited to the arrangements and instrumentality shown in the attached drawings.

DETAILED DESCRIPTION OF THE INVENTION

Referring to the drawings, a deflection electrode assembly 200 according to certain aspects of an embodiment of the present invention includes a high voltage deflection electrode 210, a low voltage (or ground) deflection electrode 220, and an insulating housing 230. As is explained in greater detail below, the insulating housing 230 functions to maintain the high and low voltage electrodes 210, 220 in a predetermined spacing relative to one another. The insulating housing 230 may be formed from any suitable dielectric material, but is preferably plastic. An external circuit (not shown) is connected to the deflection electrodes 210, 220 to create a deflection field between the electrodes so that the drops are vertically deflected in relation to their individual charges. For ease of reference herein, the deflection electrodes 210, 220 may be referred to as the high voltage deflection electrode 210 and the low voltage deflection electrode 220, or simply as the high voltage electrode 210 and the low voltage electrode 220.

The low voltage deflection electrode 220 may be a generally planar deflection electrode positioned on one side of an ink drop stream (not shown). The ink drop stream is generally the path the ink drops take as the ink drops travel longitudinally between the high voltage electrode 210 and the low voltage electrode 220. The low voltage deflection electrode 220 may also include a mounting portion 250, for securing the low voltage deflection electrode 220 to a support frame (not shown) or other mounting structure in the print head. Specifically, the mounting portion 250 includes mounting apertures 255 that align with reciprocal apertures (not shown) in the support frame. Fasteners (not shown) extend through the apertures 255 in the mounting portion 250 and thread into the apertures in the support frame to secure the low voltage electrode 220 to the support frame in an electrically grounded relationship. This connection fixes the location of the low voltage electrode 220 on the support frame, and, hence, in relation to the other print head components, such as the drop generator and the charge electrode.

The high voltage deflection electrode 210 extends along the ink drop stream at a location opposite the low voltage deflection electrode 220. The electrodes 210, 220 are spaced to define a gap 240 for the ink drop stream. The high voltage electrode 210 generally includes a front portion 212 and a rear portion 214 (see FIG. 3). The rear portion 214 extends generally parallel to the low voltage deflection electrode 220, whereas the front portion 212 angles away from the low voltage electrode 220 to generally conform to the path of the charged drops. The high voltage electrode 210 further includes a mounting bracket 225 for securing the high voltage electrode 210 to the insulating housing 230. The mounting bracket 225 is in electrical connection with a screw 228, which as will be shown below, is in electrical connection with an external power source through a resistor 310.

Figure 2:
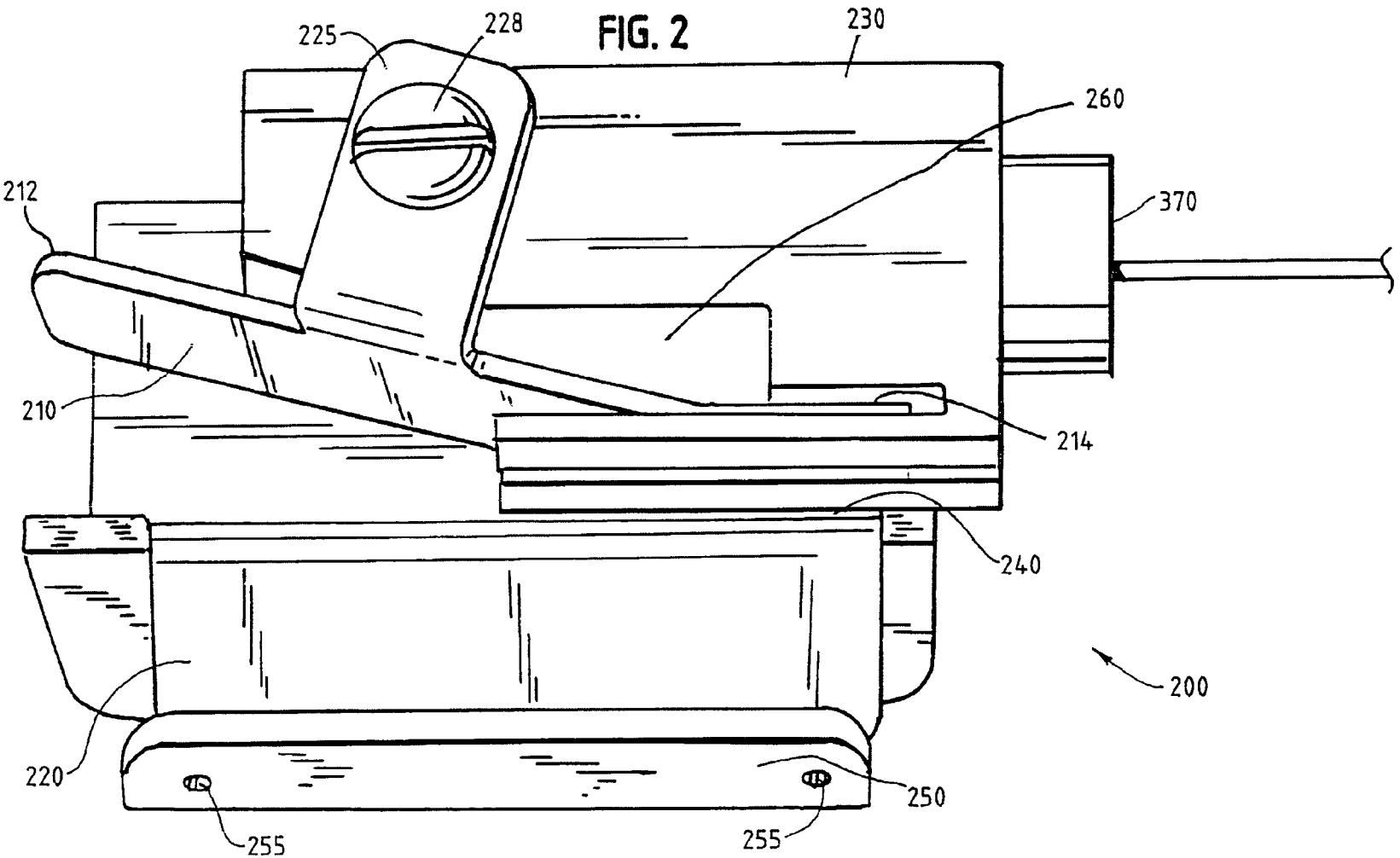
FIG. 2 illustrates certain aspects of a deflection electrode assembly according to certain aspects of a specific embodiment of the present invention.

The insulating housing 230 functions to maintain the high and low voltage electrodes 210, 220 in a predetermined spaced relationship along the ink drop stream 240. FIG. 2 shows a gap 240 that allows an ink drop stream to travel and 240 hereafter will define either the gap between the high and low voltage electrodes or the ink drop stream it allows to travel. Specifically, the rear portion 214 of the high voltage electrode 210 slides into an opening 260 in the insulating housing 230. The high voltage electrode is then secured to the insulating housing 230 by the mounting bracket 225 and the screw 228. Since the low voltage electrode 220 is also fastened to the insulating housing 230, the two electrodes are maintained in a predetermined spaced relationship (or gap) 240 relative to one another. As a result, mounting the electrodes 210, 220 in the print head is greatly simplified in comparison to prior designs in which the high and low voltage electrodes are separately mounted to the print head. In particular, the present design eliminates the need to field adjust the gap 240 between the high and low voltage electrodes because this relationship is precisely controlled by the precision manufactured insulating housing 230.

Figure 3:
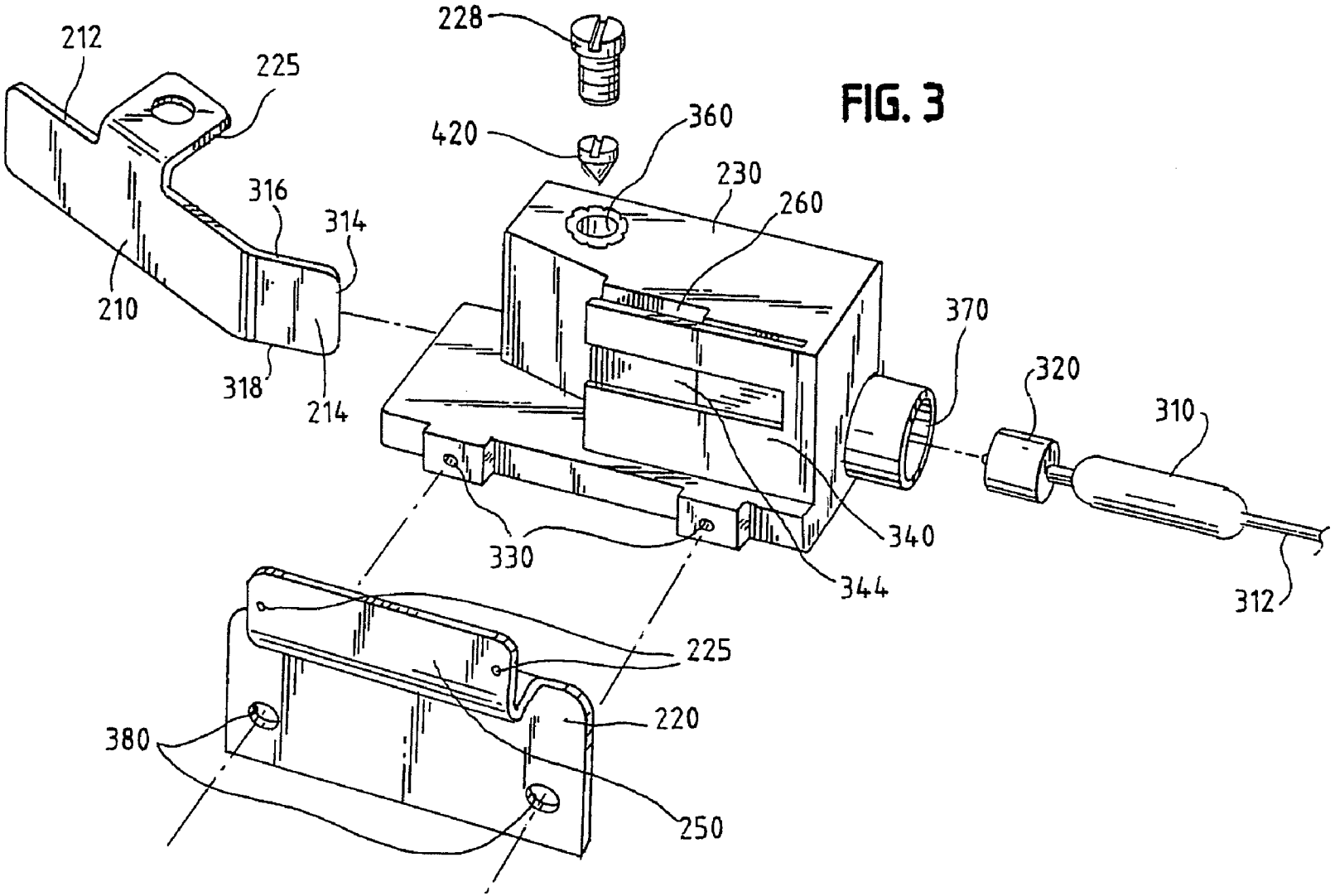
FIG. 3 illustrates an exploded bottom view of an embodiment of the present invention.

FIG. 3 shows an exploded bottom view of an embodiment of the present invention. The high voltage electrode 210, the screw 228, and the low voltage electrode 220 shown in FIG. 2 are shown removed from the insulating housing 230 in FIG. 3. Also shown in FIG. 3 are a resistor 310 and a metallic contact sleeve 320 as removed from a hole 370 in the insulating housing 230. A lead 312 is also shown connected to the resistor 310.

The bottom portion of the high voltage electrode 210, which in operation is facing the low voltage electrode 220, is shown facing the viewer. The mounting bracket 225 of the high voltage electrode 210 is shown leaning away from the viewer. The view of the insulating housing 230 shows low voltage mounting brackets 330 through which the low voltage electrode 220 is mounted to the insulating housing 230, e.g. by threaded fasteners (not shown).

The insulating housing 230 includes an integral insulation member 340 that extends along the rear edge 314 and side edges 316, 318 of the high voltage electrode 210. As shown in FIG. 3, the insulating member 340 extends inwardly beyond the edges 314, 317, and 318 of the high voltage electrode 210. Because the insulating member 340 overlaps the edges 314, 316, and 318 of the rear portion 214 of the high voltage electrode 210, the tendency for arcing to occur between the high voltage 210 and low voltage 220 electrodes is minimized.

The insulating member 340 includes a longitudinal opening or void 344, which exposes the high voltage electrode 210 along the ink drop stream. In the illustrated embodiment, the longitudinal opening 344 is in the form of a generally rectangular slot, but, as will be appreciated, the opening can assume other configurations without departing from the scope of the present invention. Removing the insulating material along the path of the ink drop stream 240 minimizes the deleterious effect that the accumulated micro-satellite drops have on the deflection field. For example, the longitudinal slot 344 may be on the order of 0.12 inches wide and it extends along substantially the entire length of the rear portion 214 of the high voltage electrode 210. In this respect, the amount of overlap between the insulating member 340 and the rear edge 314 of the high voltage electrode 210 is minimal, so that the high voltage electrode 210 is exposed along the ink drop stream 240 for substantially the entire length of the high voltage electrode 210. For example, the overlap along the rear edge 314 of the high voltage electrode 210 may be on the order of 0.010 inches.

High voltage power is delivered to the electrode 210 through a resistor 310. Specifically, the resistor 310 has a first end (or lead) connected to a power cable 312 and a second end (lead) connected to a metallic contact sleeve 320. The metallic contact sleeve 320 in turn is in electrical contact with the high voltage electrode 210 through an assembly comprising a set screw 420, a threaded inset 360 and mounting screw 228.

The resistor 310 and metallic contact sleeve 320 are inserted into a hole 370 in the insulating housing 230. By inserting the resistor 310 into the insulating housing 230, the resistor is protected from corrosive inks and cleaning solutions. Also, installation of the entire printer head is simplified, as the resistor 310 only has to be connected to an external circuit.

Figure 4:
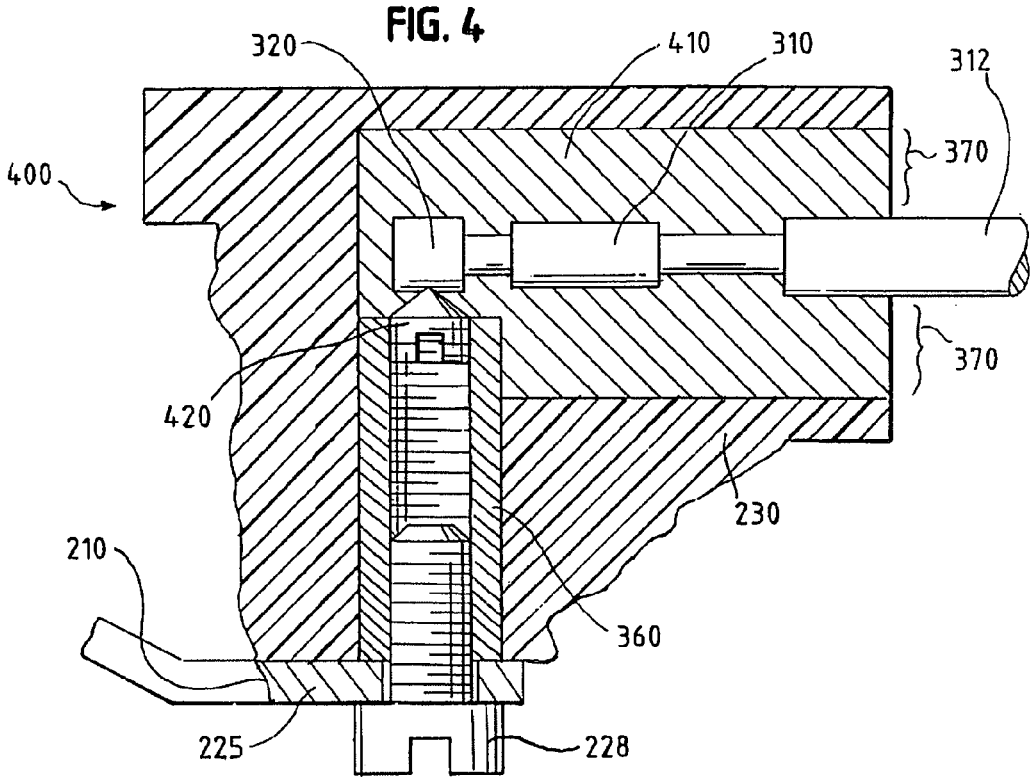
FIG. 4 illustrates a top, transparent view of an embodiment of the present invention.
Figure 10:
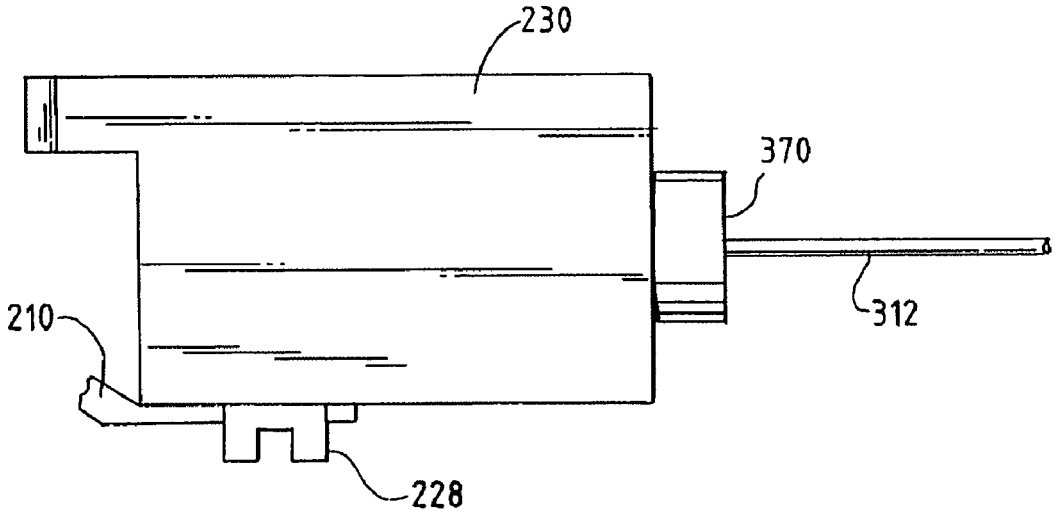
FIG. 10 is a top, opaque view of an embodiment of the present invention.

FIG. 4 and FIG. 10 show a top view of the embodiment of the present invention. FIG. 10 illustrates an opaque top view illustrating the insulating housing 230, the cable 312, the high voltage electrode 210, and the screw 228 as assembled. FIG. 4 illustrates a transparent, close up view of FIG. 10.

In FIG. 4, an epoxy 410 is shown around the metallic contact sleeve 320 and resistor 310 within the hole 370. The epoxy 410 hermetically seals the resistor 310 and metallic contact sleeve 320 within the insulating housing 230. The epoxy 410 also insulates the opposite leads of the resistor 310 from each other.

Set screw 420 is in electrical contact with the metallic contact sleeve 320. The use of the set screw 420 ensures a solid electrical contact with the metallic contact sleeve 320. The set screw 420 is also in electrical contact with the screw 228 through a threaded insert 360. The screw 228 is shown screwed into the threaded insert 360, in contact with the set screw 420 and the high voltage electrode 210. The screw 228 contacts the high voltage electrode 210 at the mounting portion 225 and supports the high voltage electrode 210 on the insulating housing 230.

The threaded insert 360 is in electrical contact with both the metallic contact sleeve 320 and the high voltage electrode 210. The threaded insert 360 contains threads for receiving screw 228. The threaded insert 360 and screw 228 serve to mount the high voltage electrode 210 to the insulating housing 230.

Figure 5:
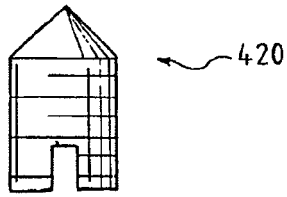
FIG. 5 illustrates a set screw from the deflection electrode assembly of FIG. 2 and FIG. 4.

FIG. 5 further illustrates the set screw 420. The set screw 420 may be screwed into the threaded insert 360 as a typical screw. The set screw 420 ensures a solid electrical contact with the metallic contact sleeve 320. The set screw 420 also functions to hold the metallic contact sleeve 320 in place if one desires to remove the screw 228 from the insulating housing 230 for maintenance or repair.

Figure 6:
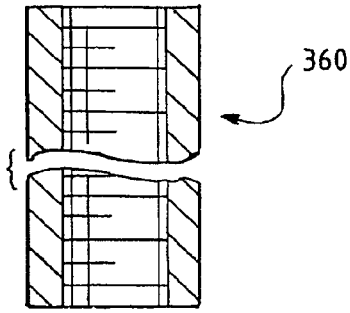
FIG. 6 illustrates a threaded insert from the deflection electrode assembly of FIG. 2 and FIG. 4.

FIG. 6 further illustrates the threaded insert 360. The threaded insert 360 is formed from an electrically conductive material, e.g., metal, and functions to provide a path for electrical connection between the metallic contact sleeve 320 and the high voltage electrode 210. The threaded insert 360 also contributes to the mounting of the high voltage electrode 210 to the insulating housing 230. Moreover, the location of the threaded insert 360 within the insulating housing 230 contributes to the predetermined spaced relationship of the high voltage and low voltage electrodes 210, 220.

Figure 7:
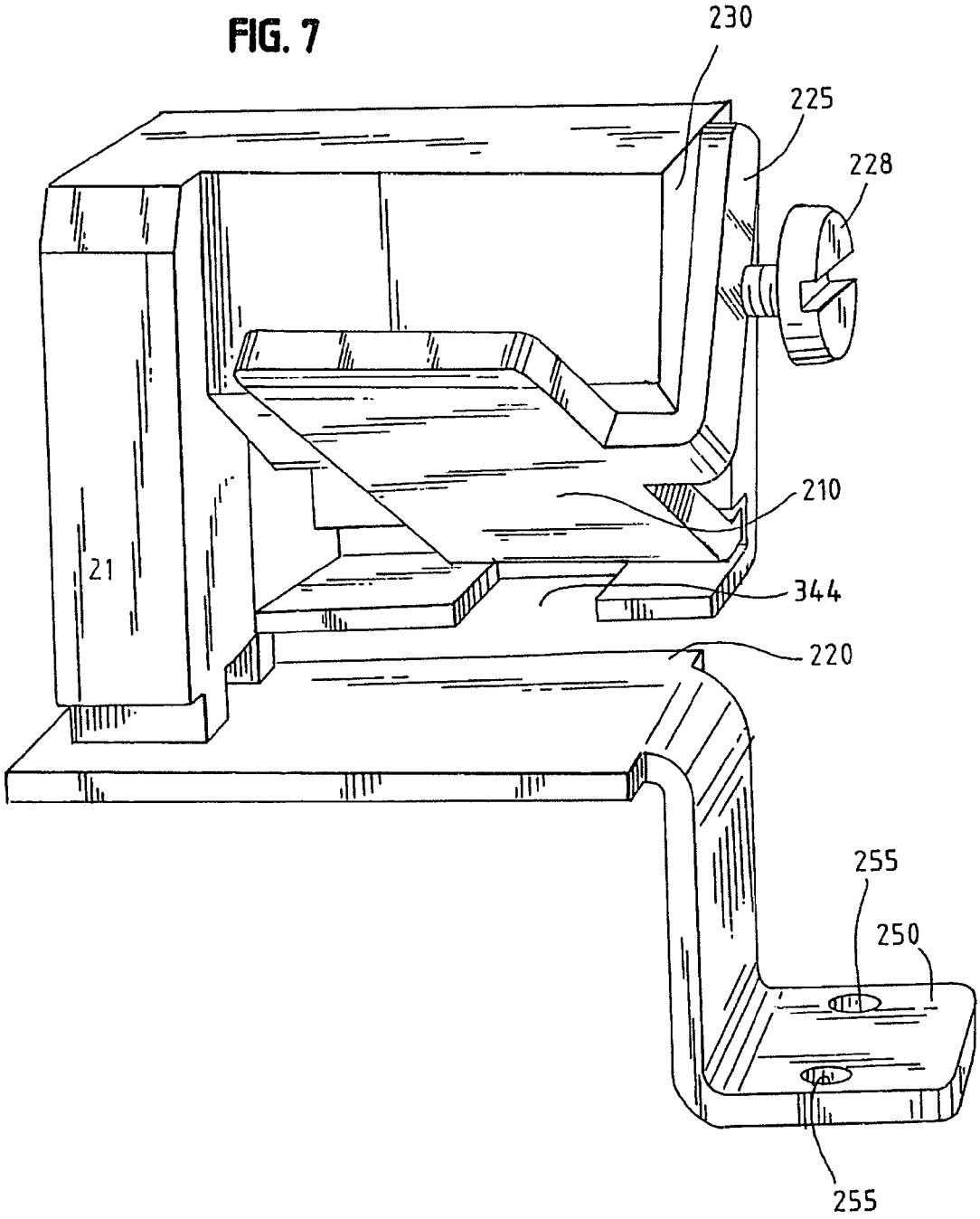
FIG. 7 is a front view of an embodiment of the present invention.

FIG. 7 illustrates a front view of an embodiment of the present invention. FIG. 7 illustrates the predetermined spaced relationship between the two electrodes 210, 220. The high voltage electrode 210 is mounted to the insulating housing 230 by the screw 228. The angle of the front of the high voltage electrode 212 can be seen. The longitudinal opening 344 in the insulating housing 230 can also be seen. As shown in FIG. 7, the insulating member 340 shields the edges of the high voltage electrode 210 from the low voltage electrode 220.

Figure 8:
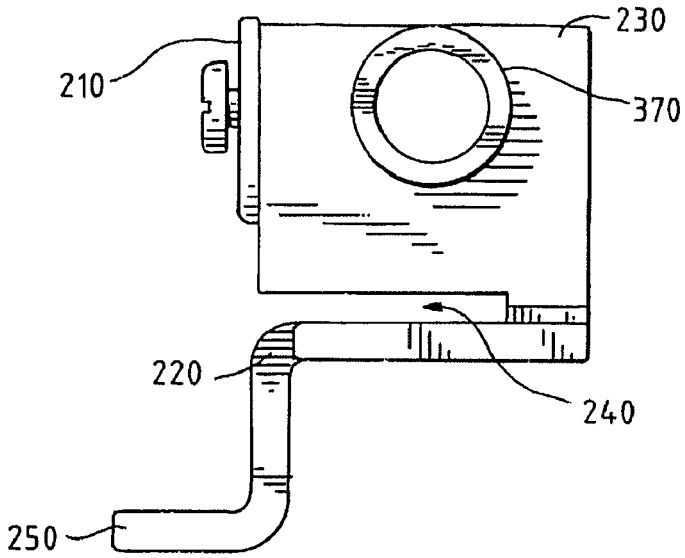
FIG. 8 is a rear view of an embodiment of the present invention.

FIG. 8 illustrates a rear view of an embodiment of the present invention. The rear view illustrates the hole 370 in the insulating housing 230 in which the resistor 310 and metallic contact sleeve 320 are inserted. In operation, the ink drops enter this end of the deflection electrode assembly at the gap 240. The ink drop stream moves along the gap 240 from back, FIG. 8, to front, FIG. 7, along the longitudinal opening 344. The ink drops travel toward the viewer of FIG. 7 through the gap 240, i.e. the ink drops exit the deflection electrode assembly from the end displayed in FIG. 7.

Figure 9:
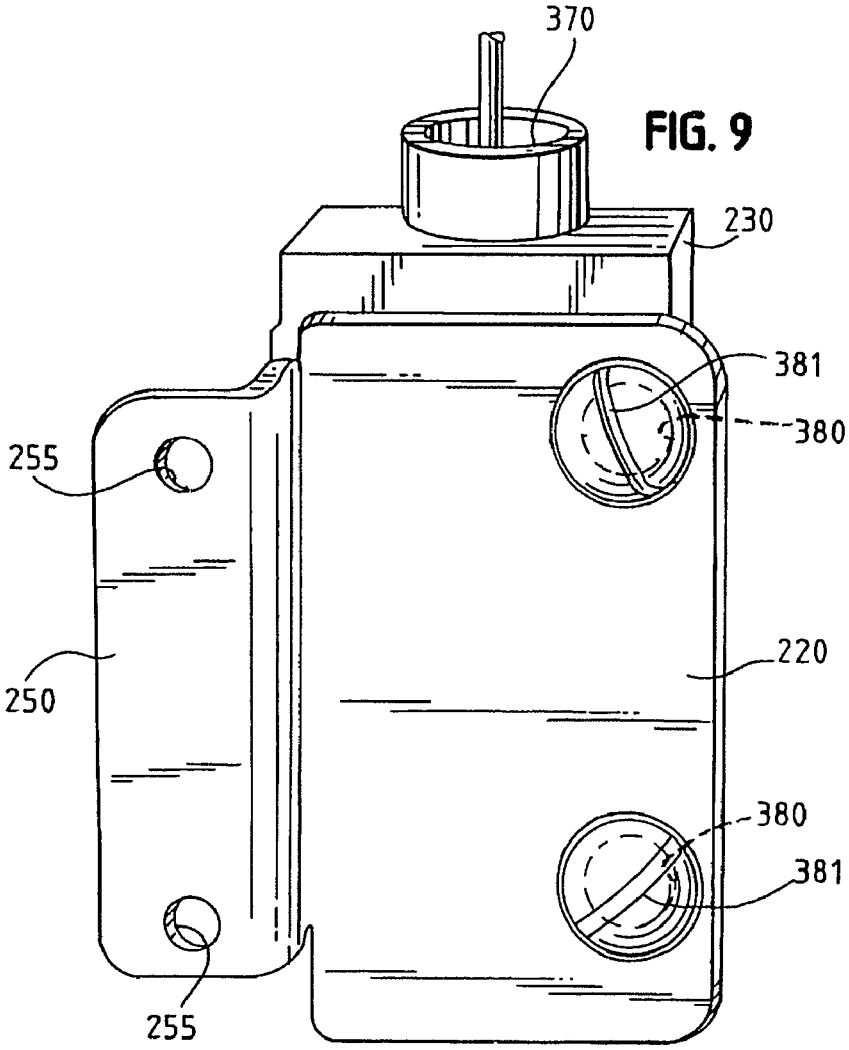
FIG. 9 is a bottom view with the low voltage electrode mounted to the insulating housing.

FIG. 9 illustrates the bottom view of an embodiment of the present invention. The low voltage electrode 220 is shown connected to the housing 230. The low voltage electrode 210 includes mounting apertures 380 (see FIG. 3) that are aligned with the low voltage mounting brackets 330. The low voltage mounting brackets 330 are an implementation of mounting threaded holes. Fastener 381 (see FIG. 9) extends through the apertures 380 and thread into reciprocal apertures in the mounting brackets 330 to secure the low voltage electrode to the insulating housing 230.

Figure 11:
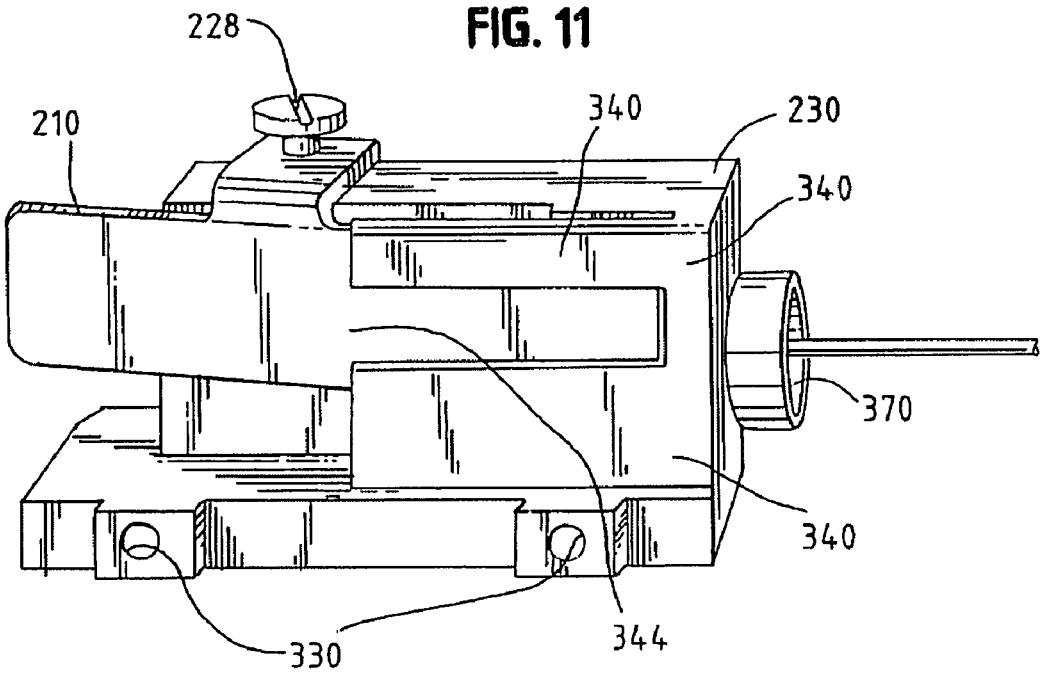
FIG. 11 is a bottom view of the present invention with the high voltage electrode inserted into the insulating housing and the low voltage electrode removed.

FIG. 11 illustrates a bottom view of the present invention with the high voltage electrode 210 inserted into the insulating housing 230, and the low voltage electrode 220 removed and not shown. In this view, the insulation member 340 that extends along the rear and side edges of the high voltage electrode 210 is visible. As shown in FIG. 3, the insulating member 340 extends inwardly beyond the edges of the high voltage electrode and overlaps a portion of the bottom of the high voltage electrode 210. Because the insulating member 340 overlaps the edges of the rear portion of the high voltage electrode 210, the tendency for arcing to occur between the high voltage 210 and low voltage 220 electrodes is minimized.

Also seen in FIG. 11 is the longitudinal opening or void 344, which exposes the high voltage electrode 210 along the ink drop stream 240. In the illustrated embodiment, the longitudinal opening 344 is in the form of a generally rectangular slot. But, as mentioned above and as will be appreciated, the opening can assume other configurations without departing from the scope of the present invention. Removing the insulating material along the path of the ink drop stream 240 minimizes the deleterious effect that the accumulated micro-satellite drops have on the deflection field.

Figure 12:
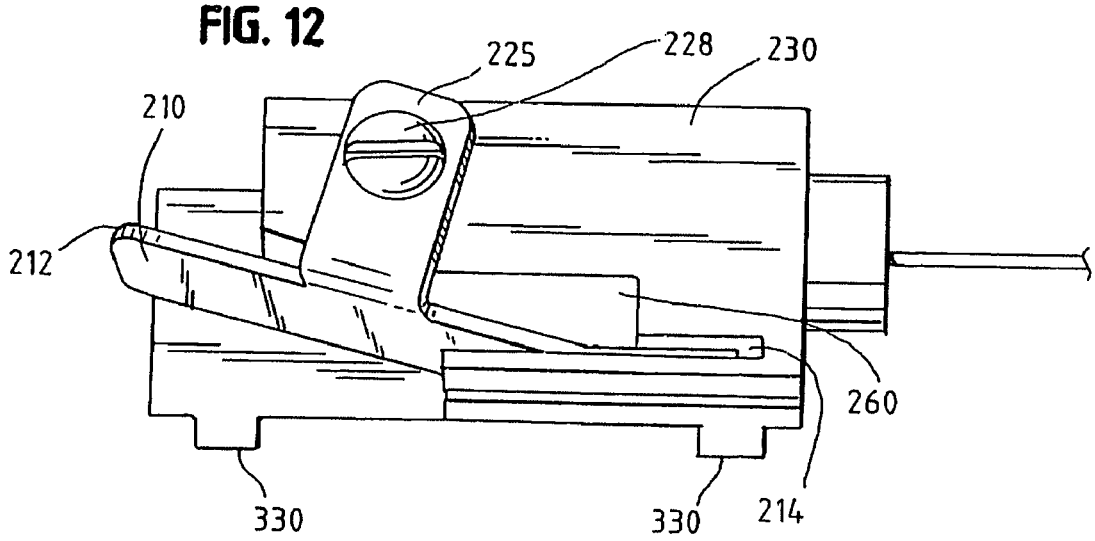
FIG. 12 is a side view of the present invention with the high voltage electrode inserted into the insulating housing and the low voltage electrode removed.

FIG. 12 illustrates a side view of the present invention with the high voltage electrode 210 inserted into the insulating housing 230 and the low voltage electrode 220 removed. In this view, the low voltage mounting brackets 330 through which the low voltage electrode 220 is mounted to the insulating housing 230 are shown. The location and size of the mounting brackets may contribute to the predetermined spaced relationship (or gap) between the two electrodes.

Figure 13:
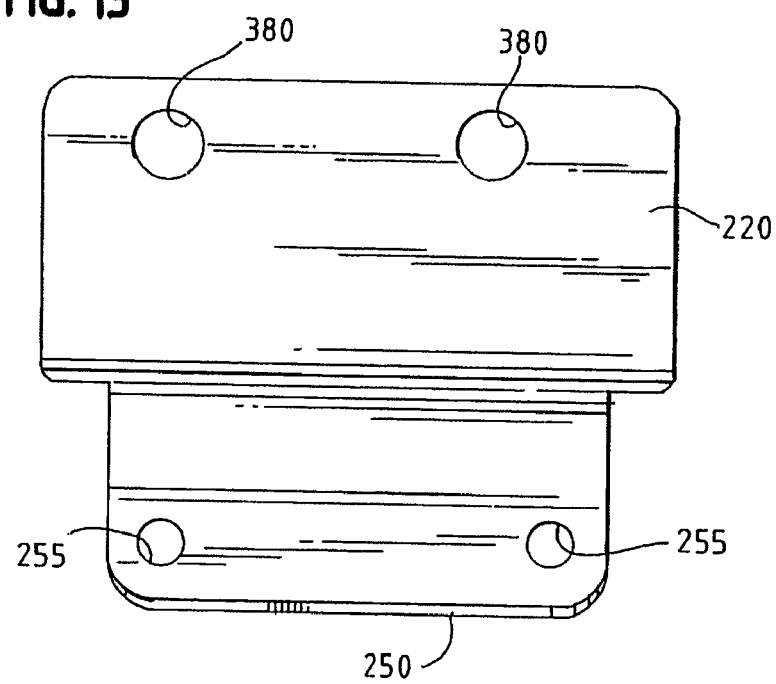
FIG. 13 is a top view of the low voltage electrode.

FIG. 13 illustrates the low voltage electrode 220. The low voltage electrode mounting members 380 are shown. The mounting members 380 are used to mount the low voltage electrode 220 to the insulating housing 230. The mounting portion 250, which is also shown, includes the mounting apertures 255. Fasteners (not shown) extend through the apertures 250 in the mounting portion 250 and thread into the apertures in the support frame to secure the low voltage electrode to the support frame in an electrically grounded relationship.

In operation of an embodiment, the low voltage electrode mount 250 may secure the deflection electrode assembly 200 as part of a print head on a grounded support frame (not shown). The extension of the low voltage electrode mount 250 contributes to the predetermined spaced relationship between the high and low voltage electrodes 210, 220. The high voltage electrode 210 may be mounted to the insulating housing 230 via the threaded insert 360, the screw 228, the high voltage electrode mounting portion 225, and the insulating member 340. The insulating member 340 protects the high voltage and low voltage electrodes 210, 220 from arcing. The location the high voltage electrode is mounted also contributes to the predetermined spaced relationship between the high and low voltage electrodes 210, 220. An external circuit may control the deflection field created between the high voltage electrode 210 and the low voltage electrode 220 through a resistor 310, a metallic contact sleeve 320, a set screw 420, and a screw 228. The resistor 210 and metallic contact sleeve 320 are hermetically sealed within the insulating housing 230. An ink drop stream may be injected into the deflection electrode assembly 200 as part of a print head. Accordingly, ink may be vertically displaced on a substrate.

Moreover, an embodiment of the invention may be constructed by sealing a resistor 310 within an insulated housing 230. In the preferred embodiment, the resistor 310 is electrically connected to a metallic contact sleeve 320 which is also sealed within an insulating housing 230. Next, a high voltage electrode 210 may be positioned on an insulating housing 230 having a predetermined spaced relationship with a low voltage electrode 220 along the ink drop stream.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the high voltage arm assembly comprising:

a high voltage electrode;

a low voltage electrode; and an insulating housing positioning the high and low voltage electrodes in a predetermined spaced relationship along the ink drop stream wherein the high voltage electrode is exposed along the path of the ink drop stream by an opening in the insulating housing.

2. A deflection electrode assembly as set forth in claim 1, wherein the insulating housing comprises an opening for supporting the high voltage electrode at a predetermined distance from the low voltage electrode.

3. A deflection electrode assembly as set forth in claim 1, wherein a portion of the insulating housing is partially between the rear edge of the high voltage electrode and the low voltage electrode.

4. A deflection electrode assembly as set forth in claim 1, wherein a portion of the insulating housing is partially between the side edges of the high voltage electrode and the low voltage electrode.

5. A deflection electrode assembly as set forth in claim 1, wherein the high voltage electrode is exposed along the path of the ink drop stream by a longitudinal opening in the insulating housing.

6. A deflection electrode assembly as set forth in claim 1, wherein the insulating housing is formed from plastic.

7. A print head for a continuous ink jet printer of the type which projects a stream of ink drops toward a substrate and controls placement of the ink drops on the substrate by selectively charging the individual ink drops and passing the charged ink drops through an electric field, the print head comprising:

a support frame;

a low voltage electrode mounted to the support frame in a grounded relationship along the ink drop stream;

a high voltage electrode; and an electrically insulating housing mounted to the low voltage electrode, the housing including a mounting feature for supporting the high voltage electrode in a predetermined spaced relation relative the to the low voltage electrode at a location along the ink drop stream opposite the low voltage electrode wherein the high voltage electrode is exposed along the path of the ink drop stream by an opening in the electrically insulating housing.

8. A print head as set forth in claim 7, wherein the insulating housing comprises an opening for supporting the high voltage electrode at a predetermined distance from the low voltage electrode.

9. A print head as set forth in claim 7, wherein a portion of the insulating housing is between the rear edge of the high voltage electrode and the low voltage electrode.

10. A print head as set forth in claim 7, wherein a portion of the insulating housing is partially between the side edges of the high voltage electrode and the low voltage electrode.

11. A print head as set forth in claim 7, wherein the high voltage electrode is exposed along the path of the ink drop stream by a longitudinal opening in the insulating housing.

12. A print head as set forth in claim 7, wherein the insulating housing is formed from plastic.

13. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

a low voltage electrode;

a high voltage electrode connected to an external circuit through a resistor, wherein the resistor is hermetically sealed within the insulating housing and the resistor is in electrical contact with a metallic contact sleeve which is within the insulating housing; and, an insulating housing supporting the high voltage electrode.

14. A deflection electrode assembly as set forth in claim 13, wherein the resistor is in electrical contact with a metallic contact sleeve which is within the insulating housing.

15. A deflection electrode assembly as set forth in claim 13, wherein the metallic contact sleeve is in electrical contact with a set screw, a screw, and a threaded insert.

16. A deflection electrode assembly as set forth in claim 15, wherein the screw and threaded insert are in electrical contact with the high voltage electrode.

17. A method for constructing a deflection electrode assembly of the type which projects a stream of ink drops toward a substrate and controls placement of the ink drops on the substrate by selectively charging the individual ink drops and passing the charged ink drops through an electric field created by the deflection electrodes, the method comprising:

sealing a resistor and a metallic contact sleeve within an insulated housing wherein the resistor is in electrical contact with the metallic contact sleeve; and positioning a high voltage electrode on an insulating housing having a predetermined spaced relationship with a low voltage electrode along the ink drop stream.

18. A method as set forth in claim 17, wherein the resistor is in electrical contact with the high voltage electrode.

19. A method as set forth in claim 17, wherein a portion of the insulating housing is partially between the high voltage electrode and the low voltage electrode.

* * * * *